US012642362B2

(12) United States Patent
Leng

(10) Patent No.: US 12,642,362 B2
(45) Date of Patent: Jun. 2, 2026

(54) SPRING HAVING POSITIONING RING AND ELASTIC MATTRESS

(71) Applicant: Luhao Leng, Fujian (CN)

(72) Inventor: Luhao Leng, Fujian (CN)

( * ) Notice: Subject to any disclaimer, the term of this patent is extended or adjusted under 35 U.S.C. 154(b) by 33 days.

(21) Appl. No.: 18/662,617

(22) Filed: May 13, 2024

(65) Prior Publication Data

US 2025/0302207 A1 Oct. 2, 2025

(30) Foreign Application Priority Data

Mar. 29, 2024 (CN) ..... 202410374059.0

(51) Int. Cl.
*A47C 27/07* (2006.01)

(52) U.S. Cl.
CPC ..... *A47C 27/07* (2013.01)

(58) Field of Classification Search
CPC ... A47C 27/065; A47C 27/068; A47C 27/063; A47C 27/07; A47C 23/002; A47C 27/064; A47C 27/056; A47C 27/053; A47C 23/30; A47C 23/057; A47C 23/05; A47C 27/06; A47C 23/0431; A47C 23/0438; A47C 23/005; A47C 27/0456; A47C 27/20; A47C 23/067; A47C 23/064; F16F 1/04; F16F 1/12
USPC ..... 267/103, 158, 160, 179; 5/247, 255, 720
See application file for complete search history.

(56) References Cited

U.S. PATENT DOCUMENTS

| | | | | |
|---|---|---|---|---|
| 3,076,203 | A | 2/1963 | Verreau | |
| 2009/0134559 | A1 * | 5/2009 | Akahori | F16F 1/128 267/179 |

FOREIGN PATENT DOCUMENTS

| | | | | |
|---|---|---|---|---|
| CN | 1161639 | A | 10/1997 | |
| CN | 209915520 | U | 1/2020 | |
| CN | 112386051 | A | 2/2021 | |
| CN | 112674540 | A | 4/2021 | |
| CN | 214258705 | U | 9/2021 | |
| CN | 117530563 | A | 2/2024 | |
| EP | 0497615 | A | 8/1992 | |
| JP | H11318643 | A | 11/1999 | |
| WO | WO-2021073601 | A1 * | 4/2021 | A47C 27/07 |

OTHER PUBLICATIONS

Notification of Grant cited in EP24175529, mailed Oct. 14, 2025, 12 pages.

(Continued)

*Primary Examiner* — Madison Matthews
(74) *Attorney, Agent, or Firm* — COOPER LEGAL GROUP LLC

(57) ABSTRACT

One or more springs having at least one positioning ring and an elastic mattress are provided. Each of the one or more springs comprises a spring body having a spiral shape formed by winding, two ends of the spring body are wound to form two end surface rings, the spring body comprises the at least one positioning ring, the at least one positioning ring is a winding ring of the spring body, the at least one positioning ring is substantially parallel to the two end surface rings or is substantially perpendicular to a direction of an elastic force of the spring body, and the at least one positioning ring is at least spaced apart from a stressing end for ¼ of a length of the one or more springs.

18 Claims, 4 Drawing Sheets

(56) References Cited

OTHER PUBLICATIONS

First Office Action cited in EP24175529, mailed Oct. 23, 2024, 5 pages.
Search Report cited in EP24175529, mailed Oct. 11, 2024, 4 pages.
International Search Report cited in PCT/CN2025/084715, mailed Jun. 13, 2025, 8 pages.
Written Opinion cited in PCT/CN2025/084715, mailed Jun. 13, 2025, 6 pages.

* cited by examiner

SPRING HAVING POSITIONING RING AND ELASTIC MATTRESS

RELATED APPLICATIONS

This application claims priority to Chinese patent application number 202410374059.0, filed on Mar. 29, 2024. Chinese patent application number 202410374059.0 is incorporated herein by reference.

FIELD OF THE DISCLOSURE

The present disclosure relates to the technical field of elastic mattresses, and in particular relates to a spring having a positioning ring and an elastic mattress.

BACKGROUND OF THE DISCLOSURE

Elasticity of existing elastic mattresses made of springs defines an integrated whole. When a part of the elastic mattress is compressed, springs around the part will be stressed. Therefore, the elastic mattress can withstand greater stress, while local elasticity of the elastic mattress cannot change with a change of posture of a human body.

The above-mentioned deficiencies are mainly caused by an installation structure of the elastic mattress. Although each of the springs of the elastic mattress should provide elasticity independently, upper ends of the springs of the elastic mattress in traditional elastic mattresses are usually connected together, so that the springs are jointly stressed so as to provide an elastic force together. Therefore, it is very important to ensure that the springs are independently stressed and the springs are not separated from each other, so that the elastic mattress can deform synchronously with the posture of the human body.

Based on the above-mentioned technical problems, the inventor designed a spring (not published yet) with a connecting waist ring, so that the springs can be connected at any portion except a stressed end. However, the connecting waist ring and a spring body may undergo relative displacement during use in a test, and connection stability of the springs is affected.

BRIEF SUMMARY OF THE DISCLOSURE

An objective of the present disclosure is to provide a spring having a positioning ring and an elastic mattress to solve the deficiencies in the existing techniques.

A technical solution of the present disclosure is as follows.

One or more springs having at least one positioning ring, each of the one or more springs comprises a spring body having a spiral shape formed by winding, two ends of the spring body are wound to form two end surface rings, the spring body comprises the at least one positioning ring, the at least one positioning ring is a winding ring of the spring body, the at least one positioning ring is substantially parallel to the two end surface rings or is substantially perpendicular to a direction of an elastic force of the spring body, and the at least one positioning ring is at least spaced apart from a stressing end for ¼ of a length of the one or more springs.

In some preferred embodiments, a length of the at least one positioning ring extends no less than 180 degrees.

In some preferred embodiments, the one or more springs comprises at least two springs; each of the at least two springs comprises one or more connecting waist rings, the at least one positioning ring is buckled to one or more inner walls of the one or more connecting waist rings, and one or more outer walls of the one or more connecting waist rings each comprise a connecting structure; and two of the at least two springs are connected through the connecting structure of a first spring of the at least two springs and the connecting structure of a second spring of the at least two springs adjacent to the first spring In some preferred embodiments, the one or more connecting waist rings comprise at least two connecting waist rings, the at least one positioning ring comprises a plurality of positioning rings, and the at least two connecting waist rings are respectively buckled to the spring body through the plurality of positioning rings.

In some preferred embodiments, the inner wall of the one or more connecting waist rings comprises a positioning groove parallel to each of the at least one positioning ring, a width of the positioning groove is no more than a height of each of the at least one positioning ring after being compressed, and each of the at least one positioning ring is buckled to an inner side of the positioning groove.

In some preferred embodiments, a length of the at least one positioning ring extends no less than 360 degrees.

In some preferred embodiments, the at least one positioning ring comprises two positioning rings, the inner wall of the one or more connecting waist rings comprises two positioning protrusions along the direction of the elastic force of the spring body, and the two positioning protrusions are buckled to the two positioning rings.

In some preferred embodiments, a distance between a first side of a first positioning protrusion of the two positioning protrusions and a first side of a second positioning protrusion of the two positioning protrusions facing away from the first side of the first positioning protrusion is no less than an initial height of a spring wire of the spring body between the two positioning rings, and the two positioning protrusions are buckled between the two positioning rings.

In some preferred embodiments, a distance between a second side of a first positioning protrusion of the two positioning protrusions and a second side of a second positioning protrusion of the two positioning protrusions facing the second side of the first positioning protrusion is no more than a compressed height of a spring wire of the spring body between the two positioning rings, and the two positioning rings are buckled between the two positioning protrusions.

In some preferred embodiments, the connecting structure of the first spring and the connecting structure of the second spring are connected together through a pin connection, a buckle connection, an insertion connection, or a fixation using a positioning block.

An elastic mattress, wherein an elastic layer of the elastic mattress comprises a plurality of the one or more springs.

The present disclosure at least has the following advantages.

1. In the present disclosure, the one or more connecting waist rings are sleeved on the spring body of the one or more springs, and the one or more connecting waist rings each comprises the connecting structure for mutual cooperation to achieve a connection between springs of the one or more springs. The one or more springs are connected together merely through the one or more connecting waist rings to ensure that the one or more springs to be not separated from each other, and relative independence between the one or more springs are ensured at the same time. The one or more springs will be stressed independently and move independently, so as to reduce interference between the one or more springs in the elastic mattress and improve comfort of the elastic mattress.

2. In the present disclosure, the spring body comprises the at least one positioning ring, and the at least one positioning ring is a winding ring of the spring body. A length of the at least one positioning ring extends no less than 180 degrees. The at least one positioning ring is substantially parallel to the two end surface rings or is substantially perpendicular to the direction of the elastic force of the spring body, so as to position the one or more connecting waist rings in subsequent assembly processes to effectively prevent displacement of the one or more connecting middle rings during use, and convenience and stability of the connection between the springs is improved.

An inclination angle of an ordinary winding ring is difficult to determine, and production of the positioning groove of the one or more connecting waist rings is hardly standardized for the ordinary winding ring. The at least one positioning ring is designed to be substantially parallel to the two end surface rings or substantially perpendicular to the direction of the elastic force of the spring body, and a location and a shape of the positioning groove can be standardized.

In addition, an inclination angle of the positioning ring has smaller variation during an elastic movement of the one or more springs. The at least one positioning ring can especially remain substantially parallel to the two end surface rings or substantially perpendicular to the direction of the elastic force of the spring body during the elastic movement when the length of the at least one positioning ring extends no less than 360 degrees. Therefore, the one or more connecting waist rings can be stably connected to the at least one positioning ring to be not easily dislocated during use.

Figure 1:
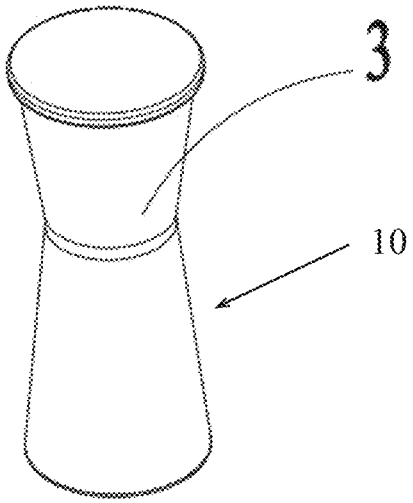
FIG. 1 illustrates a view of a structure of one or more springs in Embodiment 1.
Figure 2:
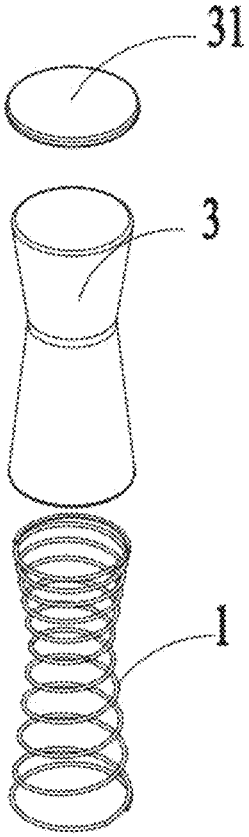
FIG. 2 illustrates an exploded view of the one or more springs in Embodiment 1.
Figure 3:
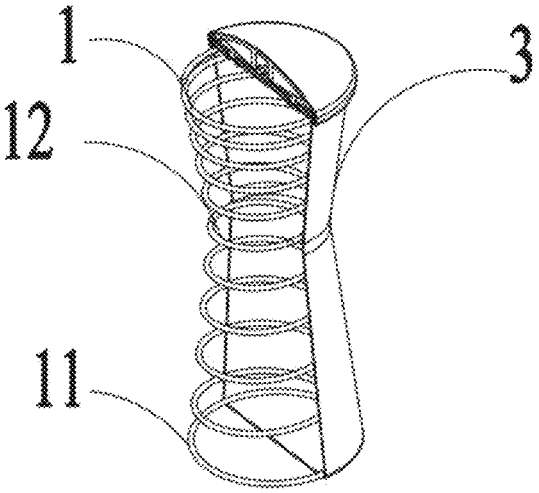
FIG. 3 illustrates a view of a structure of the one or more springs in Embodiment 1, wherein a flexible sleeve and an end cover are illustrated in a cross-sectional view.
Figure 4:
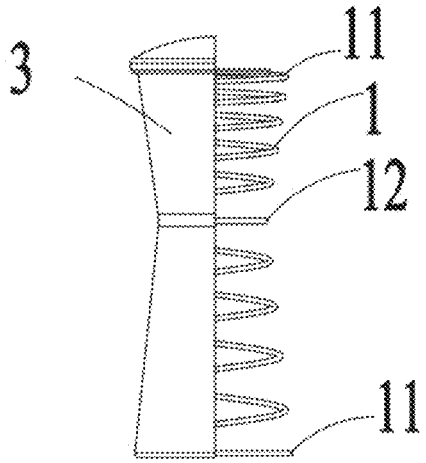
FIG. 4 illustrates a rear view of the structure shown in FIG. 3.
Figure 5:
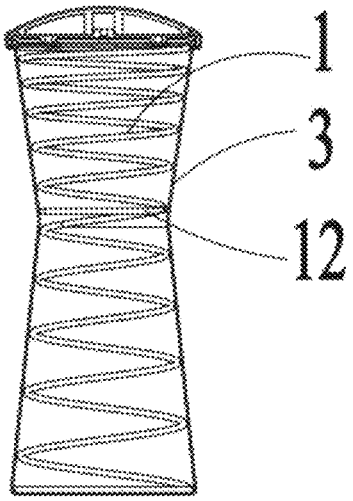
FIG. 5 illustrates a left view of the structure shown in FIG. 3.
Figure 6:
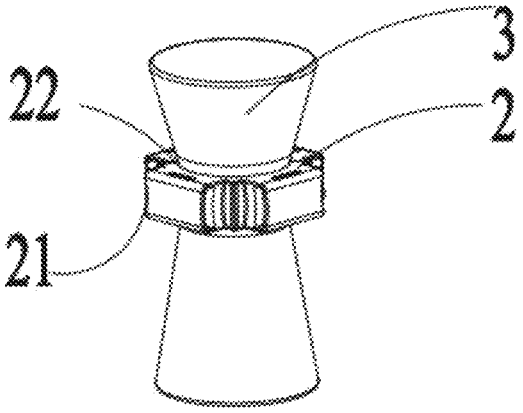
FIG. 6 illustrates a view of a structure of one or more springs in Embodiment 2.

REFERENCE NUMBERS spring body 1, end surface ring 11, positioning ring 12, spring wire 13, connecting waist ring 2, connecting structure 21, positioning groove 22, positioning protrusion 23, flexible sleeve 3, and end cover 31

DETAILED DESCRIPTION OF THE EMBODIMENTS

The technical solution of the present disclosure will be further explained and described below in combination with the specific embodiments.

The technical solutions in the embodiments of the present disclosure will be clearly and completely described in combination with the accompanying drawings in the embodiments of the present disclosure. It is obvious that the described embodiments are preferred embodiments of the present disclosure instead of being considered as exclusion of other embodiments. All other embodiments fall within the protection scope of the present disclosure provided that they are obtained by technical persons skilled in the art based on the embodiments of the present disclosure without creative works.

In the claims, the description, and the drawings of the present disclosure, unless other expressly specified, with respect to orientation terms, for example, terms "height", "upper end", "top", "bottom", "inner", "outer", "upper", "lower", "front", "rear", etc., indicate orientations or positional relationships based on orientations and positional relationships shown in the drawings, so as to easily describe the present disclosure and simplify the description, rather than indicating or implying that the referenced device or element should have a specific orientation or be constructed and operated in a specific orientation and therefore should not be understood as a limitation of the specific protective scope of the present disclosure.

In the present disclosure, due to production limitations, "substantially parallel to" means that an intersecting angle between a positioning ring and an end surface ring is less than 10 degrees, and "substantially perpendicular to" means that an intersecting angle between the positioning ring and a direction of an elastic force of a spring body is 80 degrees to 100 degrees.

A stressing end of one or more springs or the spring body refers to an end that contacts a user and is subjected to stress from the user. In the following embodiments, the stressing end refers to a top of the spring body or a top of the one or more springs.

The spring body is formed by spirally winding a spring wire, and the spring wire winds 360 degrees to form a winding ring.

Embodiment 1

This embodiment provides one or more springs 10, as shown in FIGS. 1-5. The one or more springs 10 each comprises a spring body 1, a flexible sleeve 3, and an end cover 31. Two ends of the spring body 1 are wound to form two end surface rings 11. A winding ring in a middle of the spring body 1 forms a positioning ring 12, and the positioning ring 12 is parallel to the two end surface rings 11.

In this embodiment, the positioning ring 12 is formed at the middle of the spring body 1. In other alternative embodiments, the positioning ring 12 can be disposed at any position of the spring body 1 that is at least spaced apart from a stressing end of the spring body 1 for ¼ of a length of the one or more springs 10. A main function of the positioning ring 12 is to position a connecting waist ring during a subsequent installation process, and the positioning ring 12 is disposed at the aforementioned position to ensure better independence of the one or more springs 10 after the one or more springs 10 are connected together.

The flexible sleeve 3 wraps the spring body 1, and the end cover 31 is disposed on the stressing end of the one or more springs 10. The spring body 1 is wrapped with the flexible sleeve 3 to prevent adjacent spring bodies 1 of the one or more springs 10 from being entangled during elastic movement, thereby reducing interference between the one or more springs 10. The end cover 31 forms a spherical surface at the stressing end to increases a contact area between the one or more springs 10 and the user, thereby reducing an intensity of pressure. Furthermore, the end cover 31 can be made of elastic filling materials to provide better cushioning performance for the one or more springs 10, thereby improving comfort.

An elastic mattress, an elastic layer of the elastic mattress comprises a plurality of the one or more springs 10.

Embodiment 2

Figure 7:
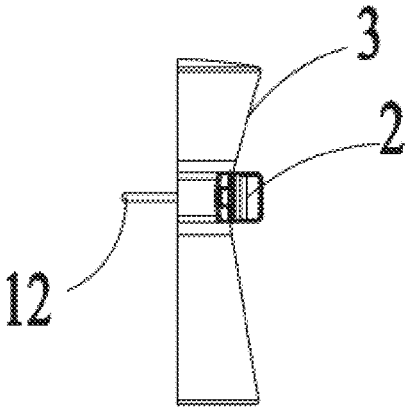
FIG. 7 illustrates a view of a structure of the one or more springs sectioned longitudinally in Embodiment 2, wherein a positioning ring is not sectioned.
Figure 8:
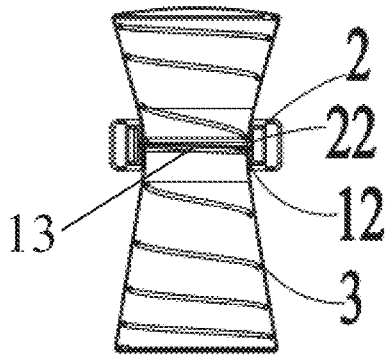
FIG. 8 illustrates a front view of the structure shown in FIG. 7.
Figure 9:
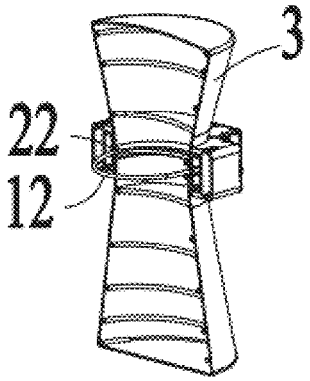
FIG. 9 illustrates a left view of the structure shown in FIG. 7.

Referring to FIGS. 6-10, the one or more springs 10 of this embodiment each comprises a spring body 1, a connecting waist ring 2, and a flexible sleeve 3. Structures of the spring body 1 and the flexible sleeve 3 are similar to those in Embodiment 1. As shown in FIGS. 8 and 9, the positioning ring 12 is perpendicular to a direction of an elastic force of the spring body 1, and the flexible sleeve 3 wraps an outer side of the spring body 1.

The connecting waist ring 2 has a connecting structure 21 and a positioning groove 22. The connecting waist ring 2 of a first one of the one or more springs 10 and the connecting waist ring 2 of a second one of the one or more springs 10 are connected to each other through the connecting structure 21, so that two of the one or more springs 10 are connected to each other. As shown in FIGS. 7 and 8, an inner wall of the connecting waist ring 2 comprises the positioning groove 22. The positioning groove 22 is parallel to the positioning ring 12, and the positioning ring 12 is buckled to the positioning groove 22 though the flexible sleeve 3.

In this embodiment, a length of the positioning ring 12 extends for 360 degrees, and a width of the positioning groove 22 is a diameter of a spring wire 13 of the positioning ring 12. In other alternative embodiments, the length of the positioning ring 12 extends more than 360 degrees, and the width of the positioning groove 22 is a total height of the positioning ring 12 after being compressed along the direction of the elastic force.

In this embodiment, the connecting waist ring 2 is sleeved outside of the spring body 1 and the flexible sleeve 3. In other alternative embodiments, the connecting waist ring 2 can be partially wrapped in the flexible sleeve 3.

Figure 10:
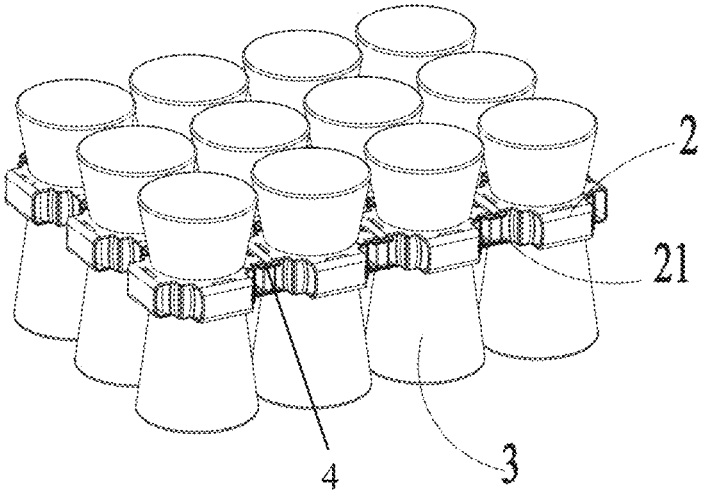
FIG. 10 illustrates a view of a structure of a plurality of the one or more springs connected together in Embodiment 2.

The connecting structure 21 comprises four connecting grooves respectively located on a front side, a rear side, a left side, and a right side of the connecting waist ring 2. As shown in FIG. 10, when the one or more springs 10 are connected together, one of the four connecting grooves of a first spring 10 of the two springs and one of the four connecting grooves of a second spring 10 of the two springs 10 move close to each other to enable the one of the four connecting grooves of the first spring 10 and the one of the four connecting grooves of the second spring 10 to be parallel, and two arms of a U-shaped insertion sheet 4 are inserted into the one of the four connecting grooves of the first spring 10 and the one of the four connecting grooves of the second spring 10.

Embodiment 3

Figure 11:
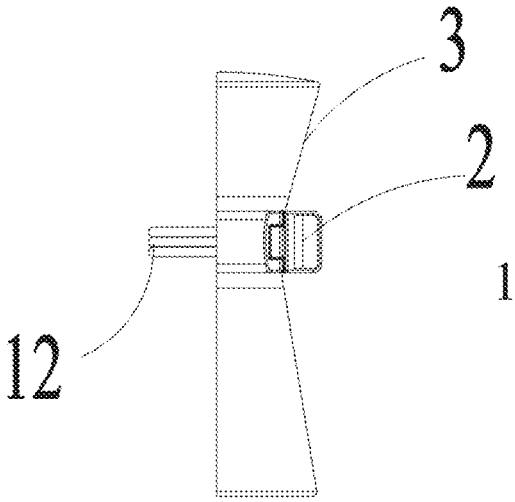
FIG. 11 illustrates a view of a structure of one or more springs sectioned longitudinally in Embodiment 3, wherein a positioning ring is not sectioned.
Figure 12:
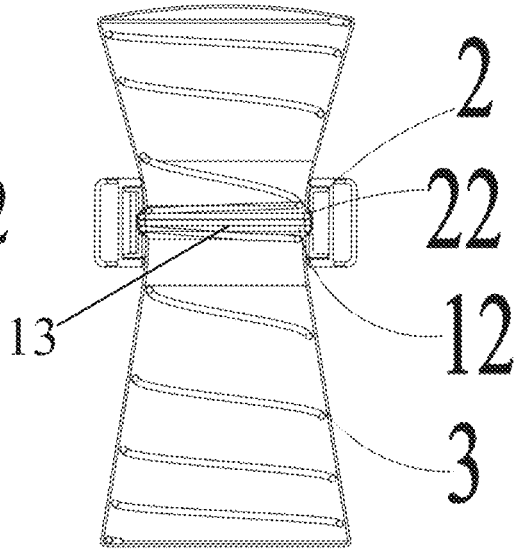
FIG. 12 illustrates a left view of the structure shown in FIG. 11.

As shown in FIGS. 11 and 12, this embodiment differs from Embodiment 2 in that the length of the positioning ring 12 extends 1080 degrees, and the width of the positioning groove 22 is three times the diameter of the spring wire 13 of the positioning ring 12 (i.e., a height of the positioning ring 12 after being compressed along the direction of the elastic force). The positioning ring 12 is compressed and buckled in the positioning groove 22.

Embodiment 4

Figure 13:
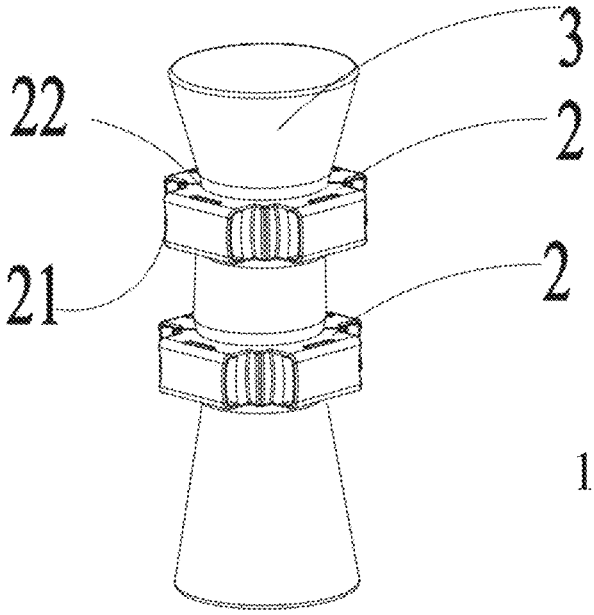
FIG. 13 illustrates a view of a structure of one or more springs in Embodiment 4.
Figure 14:
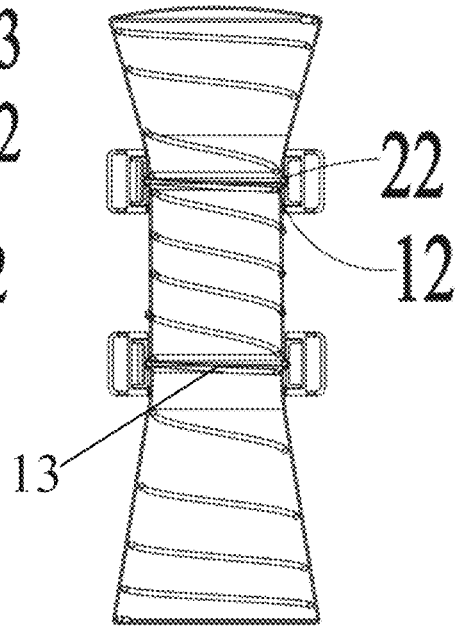
FIG. 14 illustrates a longitudinal-sectional view of Embodiment 4.

As shown in FIGS. 13 and 14, Embodiment 4 differs from Embodiment 2 in that the spring body 1 comprises two positioning rings 12, each of the one or more springs 10 comprise two connecting waist rings 2, and the two positioning rings 12 are respectively buckled to the two connecting waist rings 2.

When a height of the one or more springs 10 is larger, a connection method using a partial connection structure may lead to poor stability of an elastic mattress formed by the one or more springs 10. This embodiment greatly improves stability and comfort of the elastic mattress by arranging the two positioning rings 12 and the two connecting waist rings 2 in the direction of the elastic force of the one or more springs 10.

Embodiment 5

Figure 15:
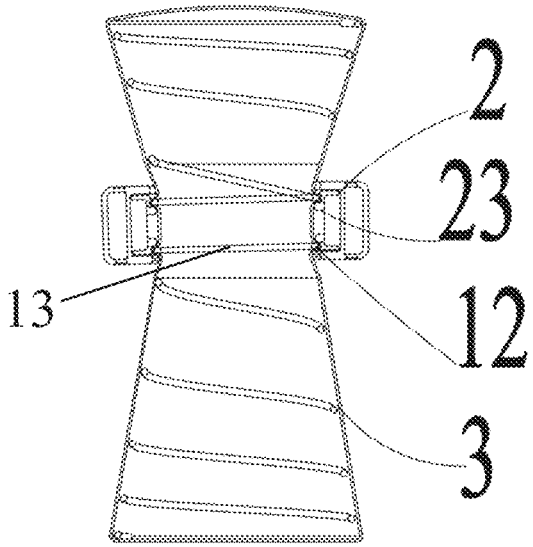
FIG. 15 illustrates a longitudinal-sectional view of Embodiment 5.

As shown in FIG. 15, Embodiment 5 differs from Embodiment 2 in that the spring body 1 comprises two positioning rings 12, and the inner wall of the connecting waist ring 2 comprises two positioning protrusions 23 that are annular. A distance between a first side of a first positioning protrusion of the two positioning protrusions 23 and a first side of a second positioning protrusion of the two positioning protrusions 23 facing away from the first side of the first positioning protrusion is greater than an initial distance between the two positioning rings 12 (i.e., an initial height of the spring wire 13 of the spring body 1 between the two positioning rings 12). Therefore, when the two positioning protrusions 23 are buckled between the two positioning rings 12, the two positioning rings 12 and the winding ring therebetween (not shown in FIG. 15) are in a stretched state.

In this embodiment, the two positioning rings 12 and the winding ring therebetween are in the stretched state to generate an elastic force to enable the two positioning rings 12 to be buckled to the two positioning protrusions 23 by interference fit, and a connection is firm. In other alternative embodiments, the distance between the first side of the first positioning protrusion and the first side of the second positioning protrusion facing away from the first side of the first positioning protrusion can be no more than the distance between the two positioning rings 12. These embodiments can also enable the connecting waist ring 2 to be sleeved on the spring body 1 through a cooperation between the two positioning protrusions 23 and the two positioning rings 12, although connection stability is slightly weaker than the connection stability of this embodiment.

Furthermore, in other alternative embodiments, the two positioning rings 12 can be buckled between the two positioning protrusions 23. At this time, preferably, a distance between a second side of the first positioning protrusion and a second side of the second positioning protrusion facing the second side of the first positioning protrusion is less than a compressed height of a spring wire 13 of the spring body 1 between the two positioning rings 12. At this time, the spring wire 13 of the spring body 1 between the two positioning rings 12 are compressed between the two positioning protrusions 23, so that the two positioning rings 12 and the two positioning protrusions 23 are connected by the interference fit. However, the technical effect of the present application can also be achieved when the distance between the second side of the first positioning protrusion and the second side of the second positioning protrusion facing the second side of the first positioning protrusion is no less than the compressed length of the spring wire 13 of the spring body 1 between the two positioning rings 12.

The aforementioned embodiments are merely some embodiments of the present disclosure, and the scope of the disclosure is not limited thereto. Thus, it is intended that the present disclosure cover equivalent variations and modifications provided they are made without departing from the appended claims and the specification of the present disclosure.

What is claimed is:

1. At least two springs each having at least one positioning ring, each of the at least two springs comprising:

a spring body having a spiral shape formed by winding, wherein:

two ends of the spring body are wound to form two end surface rings, the spring body comprises the at least one positioning ring, the at least one positioning ring is a winding ring of the spring body, the at least one positioning ring is substantially parallel to the two end surface rings or is substantially perpendicular to a direction of an elastic force of the spring body, the at least one positioning ring is disposed at a middle of the spring body, the at least one positioning ring secures one or more connecting waist rings, a first one of the one or more connecting waist rings on a first one of the at least two springs is connected to a second one of the one or more connecting waist rings on a second one of the at least two springs adjacent to the first one of the at least two springs, and the at least one positioning ring is at least spaced apart from a stressing end of the spring body for ¼ of a length of the at least two springs, each of the at least two springs comprises the one or more connecting waist rings, the at least one positioning ring is buckled to one or more inner walls of the one or more connecting waist rings, one or more outer walls of the one or more connecting waist rings each comprises a connecting structure, two of the at least two springs are connected through the connecting structure of the first one of the at least two springs and the connecting structure of the second one of the at least two springs adjacent to the first spring, at least one of the one or more inner walls of the one or more connecting waist rings comprises a positioning groove parallel to each of the at least one positioning ring, a width of the positioning groove is no more than a height of each of the at least one positioning ring after being compressed, and each of the at least one positioning ring is buckled to an inner side of the positioning groove.

2. The at least two springs according to claim 1, wherein:

a length of the at least one positioning ring extends no less than 180 degrees.

3. An elastic mattress, wherein an elastic layer of the elastic mattress comprises the at least two springs according to claim 2.

4. The at least two springs according to claim 1, wherein:

the one or more connecting waist rings comprise at least two connecting waist rings, the at least one positioning ring comprises a plurality of positioning rings, and the at least two connecting waist rings are respectively buckled to the spring body through the plurality of positioning rings.

5. The at least two springs according to claim 4, wherein:

a length of each of the plurality of positioning rings extends no less than 360 degrees.

6. The at least two springs according to claim 4, wherein:

the plurality of positioning rings comprises two positioning rings, an inner wall of each of the at least two connecting waist rings comprises two positioning protrusions along the direction of the elastic force of the spring body, and the two positioning protrusions are buckled to the two positioning rings.

7. The at least two springs according to claim 6, wherein:

a distance between a first side of a first positioning protrusion of the two positioning protrusions and a first side of a second positioning protrusion of the two positioning protrusions facing away from the first side of the first positioning protrusion is no less than an initial height of a spring wire of the spring body between the two positioning rings, and the two positioning protrusions are buckled between the two positioning rings.

8. The at least two springs according to claim 6, wherein:

a distance between a second side of a first positioning protrusion of the two positioning protrusions and a second side of a second positioning protrusion of the two positioning protrusions facing the second side of the first positioning protrusion is no more than a compressed height of a spring wire of the spring body between the two positioning rings, and the two positioning rings are buckled between the two positioning protrusions.

9. An elastic mattress, wherein an elastic layer of the elastic mattress comprises the at least two springs according to claim 4.

10. The at least two springs according to claim 1, wherein:

a length of the at least one positioning ring extends no less than 360 degrees.

11. The at least two springs according to claim 1, wherein:

the at least one positioning ring comprises two positioning rings, the at least one of the one or more inner walls of the one or more connecting waist rings comprises two positioning protrusions along the direction of the elastic force of the spring body, and the two positioning protrusions are buckled to the two positioning rings.

12. The at least two springs according to claim 11, wherein:

a distance between a first side of a first positioning protrusion of the two positioning protrusions and a first side of a second positioning protrusion of the two positioning protrusions facing away from the first side of the first positioning protrusion is no less than an initial height of a spring wire of the spring body between the two positioning rings, and the two positioning protrusions are buckled between the two positioning rings.

13. The at least two springs according to claim 11, wherein:

a distance between a second side of a first positioning protrusion of the two positioning protrusions and a second side of a second positioning protrusion of the two positioning protrusions facing the second side of the first positioning protrusion is no more than a compressed height of a spring wire of the spring body between the two positioning rings, and the two positioning rings are buckled between the two positioning protrusions.

14. The at least two springs according to claim 1, wherein:

the connecting structure of the first one of the at least two springs and the connecting structure of the second one of the at least two springs are connected together through a pin connection, a buckle connection, an insertion connection, or a fixation using a positioning block.

15. An elastic mattress, wherein an elastic layer of the elastic mattress comprises the at least two springs according to claim 1.

16. One or more springs each having at least one positioning ring, each of the springs comprising:

a spring body having a spiral shape formed by winding, wherein:

two ends of the spring body are wound to form two end surface rings, the spring body comprises the at least one positioning ring, the at least one positioning ring is a winding ring of the spring body, the at least one positioning ring is substantially parallel to the two end surface rings or is substantially perpendicular to a direction of an elastic force of the spring body, the at least one positioning ring is disposed at a middle of the spring body, the at least one positioning ring secures one or more connecting waist rings, a first one of the one or more connecting waist rings on a first one of the one or more springs is connected to a second one of the one or more connecting waist rings on a second one of the one or more springs adjacent to the first one of the one or more springs, the at least one positioning ring is at least spaced apart from a stressing end of the spring body for ¼ of a length of the one or more springs, the one or more connecting waist rings comprise at least two connecting waist rings, the at least one positioning ring comprises a plurality of positioning rings, the at least two connecting waist rings are respectively buckled to the spring body through the plurality of positioning rings, an inner wall of the at least two connecting waist rings comprises positioning grooves parallel to the plurality of positioning rings, widths of the positioning grooves are no more than heights of the plurality of positioning rings after being compressed, and the plurality of positioning rings are buckled to inner sides of the positioning grooves.

17. At least two springs each having at least one positioning ring, each of the at least two springs comprising:

a spring body having a spiral shape formed by winding, wherein:

two ends of the spring body are wound to form two end surface rings, the spring body comprises the at least one positioning ring, the at least one positioning ring is a winding ring of the spring body, the at least one positioning ring is substantially parallel to the two end surface rings or is substantially perpendicular to a direction of an elastic force of the spring body, the at least one positioning ring is disposed at a middle of the spring body, the at least one positioning ring secures one or more connecting waist rings, a first one of the one or more connecting waist rings on a first one of the at least two springs is connected to a second one of the one or more connecting waist rings on a second one of the at least two springs adjacent to the first one of the at least two springs, the at least one positioning ring is at least spaced apart from a stressing end of the spring body for ¼ of a length of the at least two springs, each of the at least two springs comprises the one or more connecting waist rings, the at least one positioning ring is buckled to one or more inner walls of the one or more connecting waist rings, one or more outer walls of the one or more connecting waist rings each comprises a connecting structure, two of the at least two springs are connected through the connecting structure of the first one of the at least two springs and the connecting structure of the second one of the at least two springs adjacent to the first spring, the at least one positioning ring comprises two positioning rings, the inner wall of the one or more connecting waist rings comprises two positioning protrusions along the direction of the elastic force of the spring body, and the two positioning protrusions are buckled to the two positioning rings.

18. One or more springs each having at least one positioning ring, each of the springs comprising:

a spring body having a spiral shape formed by winding, wherein:

two ends of the spring body are wound to form two end surface rings, the spring body comprises the at least one positioning ring, the at least one positioning ring is a winding ring of the spring body, the at least one positioning ring is substantially parallel to the two end surface rings or is substantially perpendicular to a direction of an elastic force of the spring body, the at least one positioning ring is disposed at a middle of the spring body, the at least one positioning ring secures one or more connecting waist rings, a first one of the one or more connecting waist rings on a first one of the one or more springs is connected to a second one of the one or more connecting waist rings on a second one of the one or more springs adjacent to the first one of the one or more springs, the at least one positioning ring is at least spaced apart from a stressing end of the spring body for ¼ of a length of the one or more springs, the one or more connecting waist rings comprise at least two connecting waist rings, the at least one positioning ring comprises two positioning rings, the at least two connecting waist rings are respectively buckled to the spring body through the two positioning rings, an inner wall of each of the at least two connecting waist rings comprises two positioning protrusions along the direction of the elastic force of the spring body, and the two positioning protrusions are buckled to the two positioning rings.

* * * * *